US007534283B2

(12) United States Patent
Yamada et al.

(10) Patent No.: US 7,534,283 B2
(45) Date of Patent: May 19, 2009

(54) METHOD OF PRODUCING COPPER POWDER AND COPPER POWDER

(75) Inventors: Tomoya Yamada, Okayama (JP); Koji Hirata, Honjo (JP)

(73) Assignee: Dowa Electronics Materials., Ltd., Tokyo (JP)

( * ) Notice: Subject to any disclaimer, the term of this patent is extended or adjusted under 35 U.S.C. 154(b) by 324 days.

(21) Appl. No.: 11/377,249

(22) Filed: Mar. 17, 2006

(65) Prior Publication Data

US 2006/0213328 A1 Sep. 28, 2006

(30) Foreign Application Priority Data

Mar. 22, 2005 (JP) ..... 2005-081871

(51) Int. Cl.
*B22F 8/24* (2006.01)

(52) U.S. Cl. ..... 75/373

(58) Field of Classification Search ..... 75/373
See application file for complete search history.

(56) References Cited

U.S. PATENT DOCUMENTS 5,801,318 A * 9/1998 Tani et al. ..... 75/373

FOREIGN PATENT DOCUMENTS

JP 1-290706 11/1989
JP 04-235205 A * 8/1992
JP 5-057324 8/1993
JP 10-330801 12/1998

* cited by examiner

*Primary Examiner*—George Wyszomierski
(74) *Attorney, Agent, or Firm*—Clark & Brody

(57) ABSTRACT

A method of producing copper powder is provided that uses electrolytic cuprous oxide as the starting material for the production of copper powder suitable for a conductive filler whose particles have an average particle diameter of not greater than 1 μm or even not greater than 0.5 μm and are of uniform size. In one aspect, the method comprises a step of mixing cuprous oxide with a reducing agent in a liquor in which a protective colloid is present and to which a water-soluble copper salt has been added and in another aspect comprises a step of reducing a water-soluble copper salt in a liquor in which a protective colloid is present, thereby forming a slurry, and a step of reducing cuprous oxide in the presence of the slurry. As the water-soluble copper salt can be used, for example, 0.1-20 moles of a monovalent copper salt such as cuprous chloride per 100 moles of the cuprous oxide. As the protective colloid can be used 1-40 parts by mass of a water-soluble polymer per 100 parts by mass of the cuprous oxide.

4 Claims, 2 Drawing Sheets

METHOD OF PRODUCING COPPER POWDER AND COPPER POWDER

BACKGROUND OF THE INVENTION

1. Field of the Invention

This invention relates to a low-cost method of producing a fine copper powder suitable for use as filler in a conductive paste or the like.

2. Background Art

Conductive pastes are widely used for forming electronic circuits and the external electrodes of ceramic capacitors. Typical conductive fillers used in conductive pastes include copper, nickel, silver and the like. Among these, copper is used extensively nowadays because it is inexpensive, low in resistance and excellent in anti-migration property. A conductive filler comprising a mixture of copper powders of various particle diameters is usually used in a conductive paste for the external electrodes of a ceramic capacitor. However, in order to form a dense film for improving electrode reliability, the copper powder prior to mixing needs to be one of high fineness, e.g., of a particle diameter of not greater than 1 μm or even not greater than 0.5 μm, and of uniform particle size.

Methods available for copper powder production include, for example, the atomization process, mechanical crushing process, electrolytic deposition process, vapor deposition process and wet reduction process. The wet reduction process is the main one used today because it is superior in the point of enabling efficient production of a copper powder that is composed of fine spherical particles having a narrow particle size distribution and, as such, is suitable for use in a conductive paste. For example, the prior art includes processes for obtaining fine copper powder by using hydrazine to reduce copper oxide, as taught by JP 10-330801A (Ref. No. 1), JP 1-290706A (Ref. No. 2) and JP 5-57324B (Ref. No. 3).

As can be seen from Ref. No. 2, reaction control is generally difficult in a method of reducing a bivalent copper oxide directly to copper metal because the (2-valent→1-valent) and (1-valent→0-valent) reactions progress in parallel. A copper powder of the desired particle diameter and particle size distribution is therefore hard to obtain. In response to this problem, Ref. Nos. 1 and 3 teach production of a spherical copper powder of narrow particle size distribution by reducing and precipitating homogeneous monovalent copper oxide (cuprous oxide) from bivalent copper oxide and then producing the final copper particles by a further reduction reaction. However, this prior art method is a two-stage reaction process including a first-stage reduction reaction for precipitating cuprous oxide and a second-stage reduction reaction for precipitating copper metal from the cuprous oxide and further requires liquor removal, water washing and other process to be carried out in the course between these stages. It thus consists of numerous steps and requires a long time to complete. In addition, the production cost is high owing to the need to use more than one reducing agent.

On the other hand, cuprous oxide, which is an intermediate product of the prior art production method, is produced on an industrial scale as a relatively inexpensive and high grade product among copper compounds. If, instead of the foregoing method, there should be practically applied a copper powder production method making direct use of such cuprous oxide as the starting material, it would be possible to complete the reduction in a single stage and as a result to realize improved productivity and lower cost.

However, cuprous oxide generally available for industrial purposes is manufactured by the electrolytic method. Cuprous oxide produced by this method has an average particle diameter of several μm, is of irregular particle shape, and varies in particle size distribution.

The diameter of copper particles obtained by reducing cuprous oxide ordinarily depends on the particle size distribution of the cuprous oxide. When cuprous oxide of large particle diameter is used, the particle diameter of the copper particles is large, and when cuprous oxide of small particle diameter is used, the particle diameter of the copper particles is small. Copper powder of uniform particle diameter is therefore difficult to produce with good reproducibility when electrolytic cuprous oxide is used as the starting material without further processing.

It is true that a fine copper powder can be obtained with electrolytic cuprous oxide as the starting material by adopting a measure such as adding a large amount of surfactant or refining the electrolytic cuprous oxide to a particle diameter of, say, 0.5 μm or smaller by subjecting it to crushing treatment beforehand. However, such measures cannot be easily adopted because they lead to increased cost.

SUMMARY OF THE INVENTION

The present invention was accomplished in light of the foregoing issues and has an object to provide a new method of producing fine copper powder suitable for use as conductive filler, which method can use electrolytic cuprous oxide of large and irregular particle diameter as it is as starting material.

Through various studies, the inventors discovered that this object can be achieved by a method which achieves reduction of cuprous oxide and precipitation of copper metal by first preferentially reducing a water-soluble copper salt to prepare aggregates of fine copper particles and then precipitating copper metal obtained by reducing cuprous oxide as a principal starting material using the aggregates as nuclei.

Specifically, this invention provides a method of producing copper powder by mixing cuprous oxide with a reducing agent in a liquor in which a protective colloid is present and to which a water-soluble copper salt has been added. Further, a method of producing copper powder is provided wherein a water-soluble copper salt is reduced in a liquor in which a protective colloid is present, thereby forming a slurry, and cuprous oxide is reduced in the presence of the slurry.

As the water-soluble copper salt can be preferably used a monovalent copper salt such as cuprous chloride. The amount of the copper salt used can be 0.1-20 moles of monovalent copper salt per 100 moles of cuprous oxide. The protective colloid can be used at the rate of 1-40 parts by mass of water soluble polymer per 100 parts by mass of cuprous oxide constituting the principal starting material. Cuprous oxide produced by the electrolytic method and having an average particle diameter of 3-10 μm is suitable for use as the principal starting material.

This invention provides a copper powder for conductive paste having an average particle diameter Dm of 0.2-1 μm and wherein the particle diameter of not less than 80% of all particles is in the range of 0.7 Dm-1.3 Dm. Such a copper powder can be suitably produced by the aforesaid production method.

Dm can be defined as the value obtained as follows.

Magnify the powder 20,000 times using a scanning electron microscope (SEM), select 100 copper particles at random from within the field of vision, measure the major diameter D1 and minor axis Ds of every selected particle, calculate the particle diameter D of each particle as D=(D1+Ds)/2, and define the average value of the diameters of the 100 particles as Dm.

This invention enables use of readily industrially available and relatively cheap electrolytic cuprous oxide as the principal starting material for the production of fine copper powder suitable for a conductive filler whose particles have an average particle diameter of not greater than 1 μm or even not greater than 0.5 μm and are of uniform size. Tin (Sn) contained in the electrolytic cuprous oxide as impurity can be incorporated in the copper powder, in which case the weatherability of the copper powder is markedly enhanced. The present invention therefore contributes to electronic equipment cost reduction and reliability improvement by providing a copper powder for conductive paste that is high in cost performance.

DESCRIPTION OF THE PREFERRED EMBODIMENT

Figure 1:
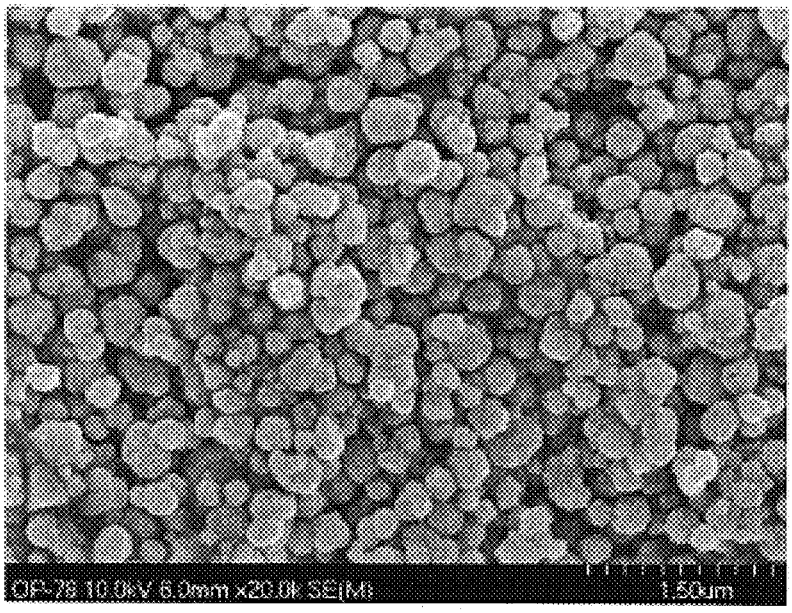
FIG. 1 is a scanning electron micrograph showing the appearance of a copper powder according to the present invention.

Based on the results of continued in-depth research, the inventors developed a method comprising a step of causing a reducing agent to act on a solution obtained by dissolving water-soluble copper salt more soluble than cuprous oxide to induce preferential early precipitation of aggregates of fine copper particles derived from the copper salt and a step of precipitating copper metal derived from a cuprous oxide principal starting material using the aggregates of fine copper particles as nuclei. By this method, even when using electrolytic cuprous oxide, fine copper powder controlled to the desired particle size can be produced unaffected by the particle size distribution of the cuprous oxide.

Thus in this method, before reduction of the cuprous oxide by the reducing agent, the Cu ions liquated out of the water-soluble copper salt that reacts more readily than the cuprous oxide rapidly react with the reducing agent to form nuclei for particle growth. Next, Cu ions liquated out of the particle surfaces of the cuprous oxide that is the principal starting material are reduced and precipitated onto the nuclei. At this time, the reduction reaction of the cuprous oxide proceeds quite gradually so that spherical copper particles of uniform particle size are formed. Therefore, the particle diameter of the obtained copper particles is determined by the number of the nuclei and does not depend on the particle size distribution of the cuprous oxide. In other words, the average particle diameter of the obtained copper powder is determined by the mass of the starting material cuprous oxide and the number of the nuclei, and the range of the particle size distribution thereof is narrow. Minute observation showed that the precipitates constituting the nuclei were secondary particles composed of aggregated copper particles of a primary particle diameter of 20-50 nm.

It is important here to add a protective colloid to the liquor in advance, before allowing the preferential reduction reaction of the water-soluble copper salt to occur. The size of the secondary particle diameter of the aggregates can be controlled by varying the amounts of copper salt and protective colloid added. Specifically, a large number of aggregates of small secondary particle diameter are produced when the amounts of copper salt and protective colloid are large, so that the particle diameter of the finally obtained copper particles becomes small. To the contrary, when the amounts of copper salt and protective colloid added are small, a small number of aggregates of large secondary particle diameter are produced, so that the particle diameter of the final copper particles becomes large. This principle can be used to control the particle diameter of the copper particles, thereby enabling production of a fine copper powder of uniform particle diameter even when using a cheap electrolytic cuprous oxide of irregular particle shape and size as the starting material.

The procedure followed can be either to mix the cuprous oxide, water-soluble copper salt and protective colloid by stirring in an aqueous liquor and add the reducing agent to the mixed liquor or to mix only the water-soluble copper salt and protective colloid together, add the reducing agent to the aqueous liquor obtained to produce the copper aggregates to serve as the nuclei in advance, and then add the cuprous oxide that is the principal starting material to the so-obtained slurry to reduce it.

As pointed out in the foregoing, from the viewpoint of production cost, the cuprous oxide used as the principal starting material is preferably electrolytic cuprous oxide having an average particle diameter of 3-10 μm. Since the production method of this invention is not essentially affected by the properties of the cuprous oxide, however, it can utilize a wide range of cuprous oxides produced by various methods and consisting of particles of various shapes and size distributions.

Although the copper salt used as the secondary starting material is required to be water soluble, it was found experimentally that use of a monovalent copper salt like cuprous acetate, cuprous nitride or cuprous chloride is preferable because such a monovalent copper salt makes the precipitation of the nuclei more uniform. The amount of the monovalent copper salt added is preferably about 0.1-20 moles per 100 moles of the starting material cuprous oxide. Addition in excess of this range is uneconomical because it does not produce a substantial change in the particle diameter of the copper powder. When the amount added falls below this range, the effect of impurities in the starting material becomes large to lower production stability.

The protective colloid used can be selected from among such common water-soluble polymers as gum arabic, polyvinyl alcohol, polyethylene glycol, polyvinylpyrrolidone, gelatin and the like. The amount added is preferably about 1-40 parts by mass per 100 parts by mass of the cuprous oxide. Addition in such an amount enables the average particle diameter Dm of the copper particles to be controlled to within the range of 0.2-1 μm.

Usable reducing agents include hydrazine, hydrazine hydrate, hydrazine compound, formaldehyde, sodium borohydride and the like. Hydrazine and hydrazine hydrate are preferable in the points of reducing power and handling ease. The amount added must be enough to completely reduce the starting materials but is preferably about 50-300 mole % relative to the total amount of copper. Addition in an amount below this range causes the reduction reaction to proceed too slowly, and addition in an amount above this range causes the reaction to become so vigorous as to make particle diameter control difficult and is also uneconomical. Addition at the rate of 80-150 mole % relative to the total amount of copper is particularly preferable.

During the reduction reaction, particularly at the particle growth stage, a complexing agent is preferably used in order to stably generate and supply Cu ions. Tartaric acid, acetic acid, citric acid and ammonia and their salts, for example, can be used as the complexing agent and added to the reaction liquor as appropriate. Moreover, as explained later, the weatherability of the copper powder is improved when it includes Sn. The Sn content of the copper powder can be controlled by adding a tin compound such as tin oxide, tin chloride or the like.

The temperature during reduction is preferably maintained at around 30-80° C. The reduction reaction proceeds too slowly at below 30° C. and at above 80° C. it becomes too vigorous, which promotes generation of secondary nuclei and makes control of particle diameter difficult. A temperature in the range of 40-60° C. is still more preferable.

It is generally considered that a copper powder for conductive paste should consist of fine (small diameter) particles and have a narrow particle size distribution. One having an average particle diameter Dm of 0.1-2 μm is usable but an average particle diameter Dm of 0.2-1 μm is still more preferable. On top of meeting the Dm requirement, it is preferable for the particle diameter of at least 80% of all particles of the copper powder to fall in the range of 0.5 Dm -1.5 Dm, more preferably for the particle diameter of not less than 80% of all particles to fall in the range of 0.7 Dm -1.3 Dm. The particle size distribution can be so regulated by using the production method explained in the foregoing. Dm can be determined by measurement using a scanning electron microscope (SEM) as explained earlier.

The obtained copper particles can be solid-liquid separated, washed and dried by an ordinary method.

Electrolytic cuprous oxide generally available on the market contains Sn as an impurity. When the aforesaid reduction and precipitation onto the nuclei occurs, Sn liquates out of the starting material electrolytic cuprous oxide together with Cu. This means that Cu ions are reduced in the presence of Sn ions to precipitate as copper metal. It is reasonable to conclude that at the time of Cu metal liquation the Sn component of the liquor is taken into the interior and onto the surface of the copper particles.

The inventors discovered that the copper powder obtained by the production method of this invention exhibits improved weatherability when it contains Sn. The mechanism by which the weatherability improves is still not clear on number of points but it is thought that the presence of Sn causes the formation of a distinctive oxide coating on the copper particle surfaces and this coating exerts an effect of inhibiting oxidation of the copper.

Experimentation showed that the effect of improving the weatherability of the copper powder produced by the Sn content is pronounced at an Sn content exceeding about 10 ppm. A marked weatherability improving effect emerges in the Sn content range of 10-100 ppm and becomes extremely high up to at least 2,000 ppm. Moreover, a weatherability improving effect can be enjoyed up to around 20,000 ppm (2 mass %). However, caution is necessary when the Sn content exceeds 20,000 ppm because the resulting decline in the purity of the copper powder is liable to have an adverse effect on the electrical and other properties of the copper powder. The Sn content of the copper powder is affected by the amount of Sn contained in the electrolytic cuprous oxide that is the principal starting material. When the amount of Sn therein is insufficient, it suffices to add a tin salt to the liquor at the time of inducing the reduction reaction. This makes it possible to control the Sn content of the copper powder to an appropriate level.

EXAMPLES

Example 1

Electrolytic cuprous oxide of an average particle diameter of 3 μm was prepared. The prepared electrolytic cuprous oxide had a broad particle size distribution, i.e., 50% or more of all particles fell outside the range of 3 μm±1 μm. The Sn content of the electrolytic cuprous oxide was 0.01 mass %. This electrolytic cuprous oxide, 135 g, was dispersed in 3,750 g of pure water. The dispersion was added with 7.5 g of cuprous chloride as water-soluble copper salt and 15 g of polyvinyl alcohol as protective colloid and then heated to 40° C. under stirring. To the heated mixture were added 100 g of 80% hydrazine hydrate as reducing agent and 22.5 g of acetic acid as complexing agent. The resulting liquor was heated to 60° C. over one hour and then held at 60° C. for another hour to allow the reduction reaction to proceed. The liquor after reaction was subjected to solid-liquid separation and the recovered solids were washed with water and dried to obtain a copper powder. The copper powder was observed under a scanning electron microscope (SEM) and the diameters of the particles within the field of vision were measured. It was found that the average particle diameter Dm was 0.3 μm and that the particle diameter of at least 80% of all particles of the copper powder fell in the range of 0.7 Dm -1.3 Dm. A scanning electron micrograph of the copper powder is shown in FIG. 1.

The copper powder was dissolved in acid and subjected to compositional analysis by ICP spectrometry. The Sn content of the copper powder was found to be 120 ppm.

Example 2

A copper powder was obtained in the same manner as in Example 1 except that the amount of cuprous chloride used was changed to 3.0 g. The copper powder was observed under a scanning electron microscope (SEM) and the diameters of the particles within the field of vision were measured. It was found that the average particle diameter Dm was 0.5 μm and that the particle diameter of at least 80% of all particles of the copper powder fell in the range of 0.7 Dm -1.3 Dm.

Example 3

To 3,750 g of pure water were added 7.5 g of cuprous chloride as water-soluble copper salt and 15 g of polyvinyl alcohol as protective colloid. The result was heated to 40° C. under stirring, whereafter 100 g of hydrazine hydrate was added as reducing agent. To the resulting reaction liquor (slurry) was added 135 g of the same electrolytic cuprous oxide as used in Example 1 and 22.5 g of acetic acid as complexing agent. The resulting liquor was heated to 60° C. over one hour and then held at 60° C. for another hour to allow the reduction reaction to proceed. The liquor after reaction was subjected to solid-liquid separation and the recovered solids were washed with water and dried to obtain a copper powder. The copper powder was observed under a scanning electron microscope (SEM) and the diameters of the particles within the field of vision were measured. It was found that the average particle diameter Dm was 0.3 μm and that the particle diameter of at least 80% of all particles of the copper powder fell in the range of 0.7 Dm -1.3 Dm.

Example 4

Copper powders were obtained in the same manner as in Example 3 except that the amount of polyvinyl alcohol used was changed to 1.5 g and 45 g. The copper powders were observed under a scanning electron microscope (SEM) and the diameters of the particles within the field of vision were measured. It was found that the average particle diameters Dm were 0.8 μm and 0.2 μm for the copper powders obtained using 1.5 g and 45 g of polyvinyl alcohol. It was also found that the particle diameter of at least 80% of all particles of both copper powders fell in the range of 0.7 Dm -1.3 Dm.

Example 5

A copper powder was obtained in the same manner as in Example 1 except that an electrolytic cuprous oxide having an average particle diameter of 0.5 μm was used. The copper powder was observed under a scanning electron microscope (SEM) and the diameters of the particles within the field of vision were measured. It was found that the average particle diameter Dm was 0.3 μm and that the particle diameter of at least 80% of all particles of the copper powder fell in the range of 0.7 Dm -1.3 Dm.

Example 6

A copper powder was obtained in the same manner as in Example 1 except that copper sulfate, 7.5 g, was used in place of cuprous chloride. The copper powder was observed under a scanning electron microscope (SEM) and the diameters of the particles within the field of vision were measured. It was found that the average particle diameter Dm was 0.3 μm and that the particle diameter of at least 80% of all particles of the copper powder fell in the range of 0.7 Dm-1.3 Dm.

Example 7

A copper powder was obtained in the same manner as in Example 3 except that 0.43 g of tin chloride was added just before adding the acetic acid. The copper powder was observed under a scanning electron microscope (SEM) and the diameters of the particles within the field of vision were measured. It was found that the average particle diameter Dm was 0.3 μm and that the particle diameter of at least 80% of all particles of the copper powder fell in the range of 0.7 Dm-1.3 Dm. The Sn content of the copper powder was analyzed by compositional analysis conducted in the same manner as in Example 1 and found to be 1,900 ppm.

Comparative Example 1

Figure 2:
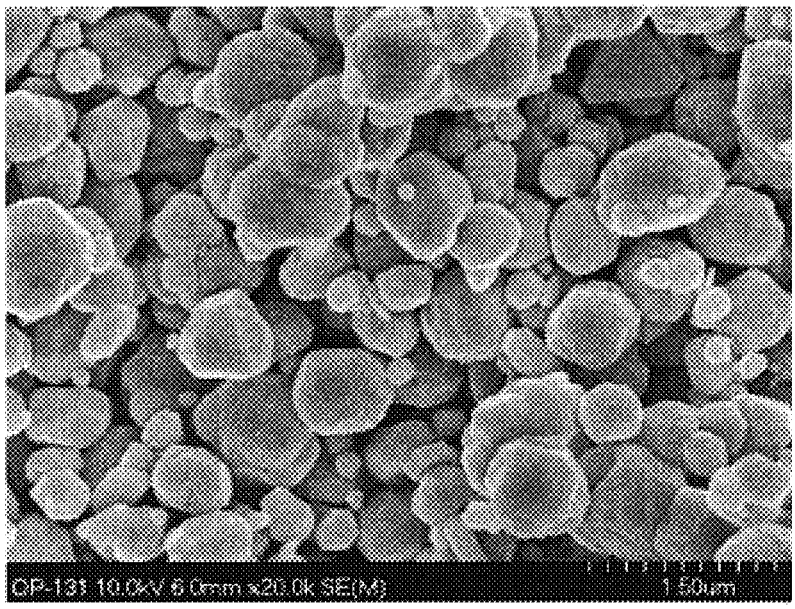
FIG. 2 is a scanning electron micrograph showing the appearance of a copper powder according to a comparative example.

A copper powder was obtained in the same manner as in Example 1 except that no cuprous chloride was used. The copper powder was observed under a scanning electron microscope (SEM) and the diameters of the particles within the field of vision were measured. It was found that the copper powder comprised a mixture of particles with particle diameters in the range of 0.5 μm -1.1 μm. A scanning electron micrograph of the copper powder is shown in FIG. 2.

Comparative Example 2

A copper powder was obtained in the same manner as in Example 5 except that no cuprous chloride was used. The copper powder was observed under a scanning electron microscope (SEM) and the diameters of the particles within the field of vision were measured. It was found that the copper powder comprised a mixture of particles with particle diameters in the range of 0.3-0.6 μm.

Comparative Example 3

Copper sulfate, 110 g, was dissolved in 330 g of pure water, the solution was neutralized by adding 90 g of sodium hydroxide, and 440 g of 60% glucose solution was then added to the neutralized solution. Cuprous oxide was precipitated by a reduction reaction progressing at 70° C. Hydrazine hydrate, 120 g, was added to the resulting cuprous oxide slurry and the slurry was heated to 90° C. over 3 hours to allow a reduction reaction to proceed. The liquor after reaction was subjected to solid-liquid separation and the recovered solids were washed with water and dried to obtain a copper powder. The copper powder was observed under a scanning electron microscope (SEM) and the diameters of the particles within the field of vision were measured. It was found that the average particle diameter Dm was 0.3 μm. The Sn content of the copper powder was analyzed by compositional analysis conducted in the same manner as in Example 1 and found to be 3 ppm.

Weatherability Test

The copper powders obtained in Examples 1 and 2 and Comparative Example 1 were individually exposed to atmospheric air in a thermostatic chamber. After a fixed time period, their oxygen amounts were measured by the method of fusion in an inert gas and infrared ray absorption. With this method there were ascertaining the time-course change in oxygen absorption amount in a 25° C., R.H. 30% atmosphere. The results are shown in FIG. 3.

Figure 3:
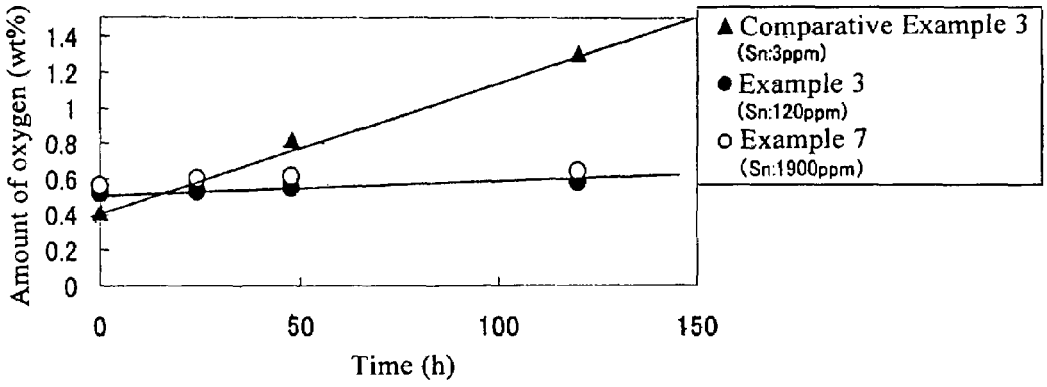
FIG. 3 is a graph showing the results of a weatherability test.

As can be seen in FIG. 3, the amount of oxygen absorbed at room temperature by the Sn-containing copper powders of the Examples was very low, so that they exhibited outstanding weatherability. In contrast, the copper powder of the Comparative Example, which contained almost no Sn, absorbed an increasing amount of oxygen over the course of time and was thus inferior in weatherability.

What is claimed is:

1. A method of producing copper powder comprising a step of reducing a water-soluble copper salt in a liquor in which a protective colloid is present, thereby forming a slurry including aggregates of fine copper particles, and a step of reducing cuprous oxide in the presence of the slurry, wherein the water-soluble copper salt is a monovalent water-soluble copper salt and the cuprous oxide is produced by an electrolytic method and has an average particle diameter of 3-10 μm.

2. A method of producing copper powder according to claim 1, wherein the monovalent water-soluble copper salt is cuprous chloride.

3. A method of producing copper powder according to claim 1, wherein 0.1-20 moles of the monovalent water-soluble copper salt are used per 100 moles of the cuprous oxide.

4. A method of producing copper powder according to claim 1, wherein 1-40 parts by mass of a water-soluble polymer is used as the protective colloid per 100 parts by mass of the cuprous oxide.

* * * * *